United States Patent [19]

Arima

[11] Patent Number: 4,944,503

[45] Date of Patent: Jul. 31, 1990

[54] DIVISION SHEET FEEDING APPARATUS AND METHOD

[75] Inventor: Shinichi Arima, Shizuoka, Japan

[73] Assignee: Fuji Photo Film Co., Ltd., Kanagawa, Japan

[21] Appl. No.: 442,467

[22] Filed: Nov. 30, 1989

Related U.S. Application Data

[63] Continuation of Ser. No. 200,151, May 26, 1988, abandoned.

[30] Foreign Application Priority Data

May 26, 1987 [JP] Japan ..... 62-128849

[51] Int. Cl.[5] ..... B65H 33/04

[52] U.S. Cl. ..... 270/95; 270/52; 83/73; 83/363

[58] Field of Search ..... 270/52, 52.5, 58, 59, 270/95; 83/72, 73, 74, 76, 363, 365, 369

[56] References Cited

U.S. PATENT DOCUMENTS

| | | | |
|---|---|---|---|
| 1,942,870 | 1/1934 | Matthews | 270/95 |
| 2,382,998 | 8/1945 | Kleinshmidt | 270/95 |
| 2,619,883 | 12/1952 | Andren | 270/59 |
| 3,466,983 | 9/1969 | Meyer-Jagenberg | 270/95 |
| 3,543,929 | 12/1970 | Mattia | 83/79 |
| 3,732,761 | 5/1973 | Sanders | 83/369 |
| 3,979,112 | 9/1976 | Munn et al. | 270/59 |
| 4,587,913 | 5/1986 | Yin et al. | 270/56 |

*Primary Examiner*—Edward K. Look
*Assistant Examiner*—Therese M. Newholm
*Attorney, Agent, or Firm*—Sughrue, Mion, Zinn, Macpeak & Seas

[57] ABSTRACT

A division sheet feeding method comprises the steps of laying at least one division sheet, which is fed by a division sheet conveyance device, upon a group of a predetermined number of product sheets each time the predetermined number of the product sheets are stacked one upon another by a sheet stacking device in the course of cutting a product web by a product web cutting device into the product sheets having predetermined sizes, conveying the product sheets by a product sheet conveyance device, and stacking the product sheets by the sheet stacking device. A division sheet web is cut as required to obtain the division sheet, and the division sheet is fed to the division sheet conveyance device.

4 Claims, 4 Drawing Sheets

DIVISION SHEET FEEDING APPARATUS AND METHOD

This is a continuation of application Ser. No. 07/200,151, filed 5/26/88, now abandoned.

BACKGROUND OF THE INVENTION

1. Field of the Invention

This invention relates to a method of feeding a division sheet in the case where the division sheet is to be inserted between stacked product sheets.

2. Description of the Prior Art

Sheet-shaped materials (hereinafter referred to simply as sheets) such as paper sheets and thin metal sheets are formed by, for example, cutting a belt-shaped material into predetermined lengths, and are then often stacked in the aligned form for next processes such as take-out and packaging. In the case where the sheets as products are stacked, a division sheet is generally inserted between the groups each of which is composed of a predetermined number of the product sheets for the subsequent process, for example, between the groups each of which is composed of the product sheets in a single packaging unit for the packaging process.

As mentioned above, the product sheets which are formed by, for example, cutting them from a product web, are conveyed to a stacking position, and then sequentially laid one upon another. On the other hand, the division sheet has heretofore been taken out of a stack of the division sheets which had already been formed in predetermined sizes, and inserted between the groups each of which is composed of a predetermined number of the product sheets. Specifically, as disclosed in, for example, Japanese Unexamined Patent Publication No. 59(1984)-203061, it was necessary for the division sheets to be cut in sizes corresponding to the sizes of the product sheets and stacked prior to the formation of the product sheets.

With the conventional technique wherein it is necessary for the division sheets to be prepared in advance, deficiency of the division sheets may arise in the course of, for example, the cutting of the product web in the case where counting of the prepared division sheets was erroneous or the number of the product sheets which are to be formed by the cutting is increased. In this case, the operation of the apparatus for processing must be stopped in the course of processing such as the cutting of the product web in the rolled form or the like into the product sheets, and therefore much loss arises with regard to the operation of the equipment.

Also, in order to prevent loss with regard to the operation of the equipment or to provide spare division sheets for replacement for division sheets damaged at the time a failure arises in the course of the feeding of the division sheets, it has heretofore been necessary to prepare the division sheets in a number larger than the necessary number. Therefore, some loss has heretofore been caused by a chronic surplus of the division sheets.

Also, in the case where the sizes of the product sheets are to be changed in the course of production of the product sheets, it is necessary to change the sizes of the division sheets in accordance with the new sizes of the product sheet. Therefore, in this case, the operation of the processing apparatus must be stopped for replacing the division sheets, which have been stacked for insertion between groups of the product sheets, by division sheets having the sizes corresponding to the sizes of the product sheets, and much loss is caused by the stop of the processing apparatus.

SUMMARY OF THE INVENTION

The primary object of the present invention is to provide a division sheet feeding method and apparatus wherein division sheets need not be prepared in advance in a number larger than the necessary number, and no loss is caused by a chronic surplus of the division sheets:

Another object of the present invention is to provide a division sheet feeding method and apparatus wherein, in the case where the sizes of the product sheets are to be changed in the course of production of the product sheets, the operation of replacing the division sheets by those having the sizes corresponding to the new sizes of the product sheets is eliminated, and the operation of the processing apparatus need not be stopped.

The present invention provides a division sheet feeding method and apparatus for laying at least one division sheet, which is fed by a division sheet conveyance means, upon a group of a predetermined number of product sheets each time the predetermined number of the product sheets are stacked one upon another by a sheet stacking means in the course of cutting a product web by a product web cutting means into the product sheets having predetermined sizes, conveying the product sheets by a product sheet conveyance means, and stacking the product sheets by the sheet starking means, wherein the improvement comprises the steps of: cutting a division sheet web as required to obtain said division sheet, and feeding said division sheet to said division sheet conveyance means.

With the division sheet feeding method and apparatus in accordance with the present invention, processing such as cutting of the division sheet web is carried out for forming the division sheets in a number necessary for a single insertion step each time a predetermined number of the product sheets are formed by processing such as cutting of the product web, and the necessary number of the division sheets are laid upon the group of the product sheets each time the predetermined number of the product sheets are stacked one upon another. Therefore, the division sheet material remains as the division sheet web after the division sheets are formed, and the division sheets having any size can be formed when the sizes of the division sheets are to be changed.

Accordingly, with the division sheet feeding method and apparatus in accordance with the present invention wherein the division sheets are formed in a number necessary for the insertion step just before the division sheets become necessary, the division sheets in a number larger than the necessary number need not be prepared in advance, and no loss is caused by a chronic surplus of the division sheets. Also, in the case where the sizes of the division sheets are to be changed in the course of production of the product sheets, the division sheets having different sizes can be formed readily without the processing apparatus being stopped. Therefore, the operation of replacement of the division sheets need not be carried out, the processing apparatus need not be stopped for the replacement operation, and it is possible to prevent generation of loss caused by the stop of the processing apparatus.

DESCRIPTION OF THE PREFERRED EMBODIMENTS

The present invention will hereinbelow be described in further detail with reference to the accompanying drawings.

Figure 1:
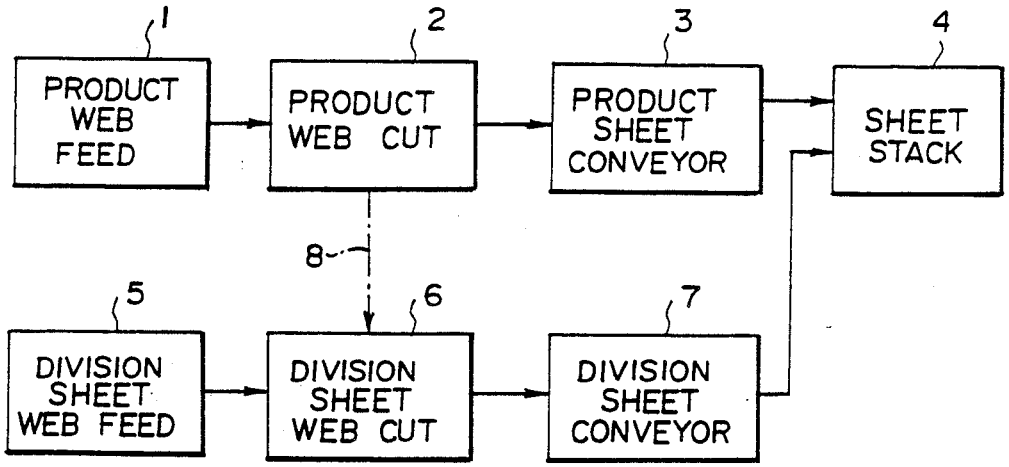
FIG. 1 is a block diagram showing an embodiment of the division sheet feeding method in accordance with the present invention.

With reference to FIG. 1, a product web is fed by a product web feed-out means 1 to a product web cutting means 2. (In the case where the product web is in the rolled form, the product web is fed by unwinding. In the case where the product web is in the sheet form, the product web is fed in the sheet form.) At the product web cutting means 2, the product web received from the product web feed-out means 1 is cut into predetermined sizes, and other processing steps are carried out in some cases, thereby to form product sheets. The product sheets are conveyed by a product sheet conveyance means 3, and stacked one upon another at a stacking section which constitutes a sheet stacking means.

Division sheets are formed in the same manner. Specifically, a division sheet web is fed by a division sheet web feed-out means 5 to a division sheet web cutting means 6, and is cut by the division sheet web cutting means 6 to form the division sheets. Then, the division sheets are conveyed by a division sheet conveyance means 7 to the aforesaid stacking section, and are fed between groups each of which comprises a predetermined number of the product sheets.

At this time, information on the sizes of the product sheets formed by processing of the product web and information on the timing of the formation of the division sheets which are to be inserted after the predetermined number of the product sheets are formed are transmitted by a product sheet information transmitting means 8 from, for example, the product web cutting means 2 to the division sheet web cutting means 6. In this manner, the division sheets having the sizes corresponding to the sizes of the product sheets are formed in a number necessary for a single insertion step at the time exactly prior to the insertion of the division sheets.

Figure 2:
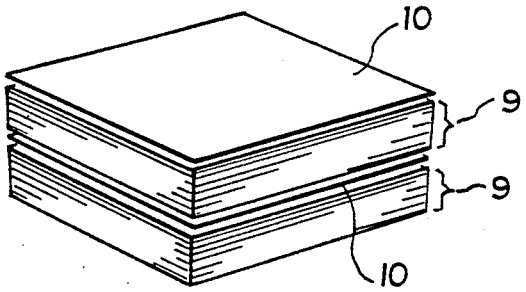
FIG. 2 is an explanatory view showing the stacking condition.

FIG. 2 shows the stacking condition of groups each of which is composed of a predetermined number of product sheets 9, 9, . . ., and division sheets 10, 10 each of which is formed to have a size equal to the sizes of the product sheets 9, 9, . . . and laid upon each of the groups of the product sheets 9, 9, . . .

A single division sheet 10 may be inserted between the groups each of which is composed of a predetermined number of the product sheets 9, 9, . . . for the purpose of the division between the groups each of which is composed of the predetermined number of the product sheets 9, 9, . . . Alternatively, two division sheets 10, 10 may be laid one upon the other and inserted between the groups each of which is composed of the predetermined number of the product sheets 9, 9, . . . so that a single division sheet 10 is positioned at the top surface and the bottom surface of each group of the predetermined number of the product sheets 9, 9, . . . at the time the stacked product sheets 9, 9, . . . are taken out and packaged.

The sizes of the division sheets 10, 10 need not necessarily be equal to the sizes of the product sheets 9, 9, . . . For example, the sizes of the division sheets 10, 10 may be adjusted to be larger than the sizes of the product sheets 9, 9, . . . , and the division sheets 10, 10 may be utilized as the packaging sheets at the time the stacked product sheets 9, 9, . . . are taken out and packaged.

Figure 3:
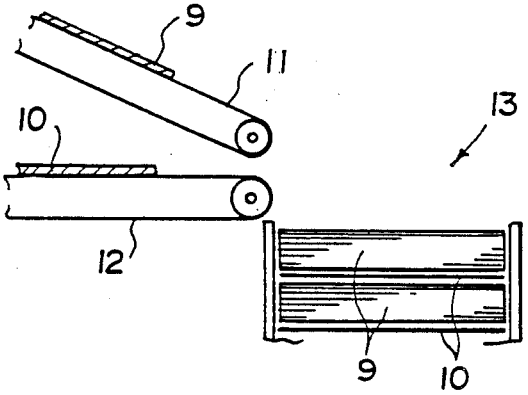
FIG. 3 is a conceptual view showing the stacking method.

FIG. 3 shows an example of the method of stacking by feeding the division sheet 10 for each group of the predetermined number of the product sheets 9, 9, . . .

With reference to FIG. 3, the product sheets 9, 9, . . . are conveyed by a product sheet conveyor 11, which constitutes the product sheet conveyance means 3, to a stacking section 13 which constitutes the sheet stacking means 4. The division sheets 10, 10 are conveyed by a division sheet conveyor 12, which constitutes the division sheet conveyance means 7, to the stacking section 13.

The timing of feeding of the division sheet 10 to the stacking section 13 is controlled by the control of the timing of the cutting of the division sheet web by the division sheet web cutting means 6, or by the control of the transferring of the division sheet 10 to the product sheet conveyance means 3 after the division sheet 10 is formed by the cutting, or by the provision of a division sheet wait means (not shown) for maintaining the division sheet 10 till a predetermined time in the middle of the path of conveyance by the product sheet conveyance means 3. In this manner, the timing of feeding of the division sheet 10 to the stacking section 13 is controlled so that a single division sheet 10 or a predetermined number of the division sheets 10, 10, . . . are fed each time the predetermined number of the product sheets 9, 9, . . . are stacked.

Figure 4:
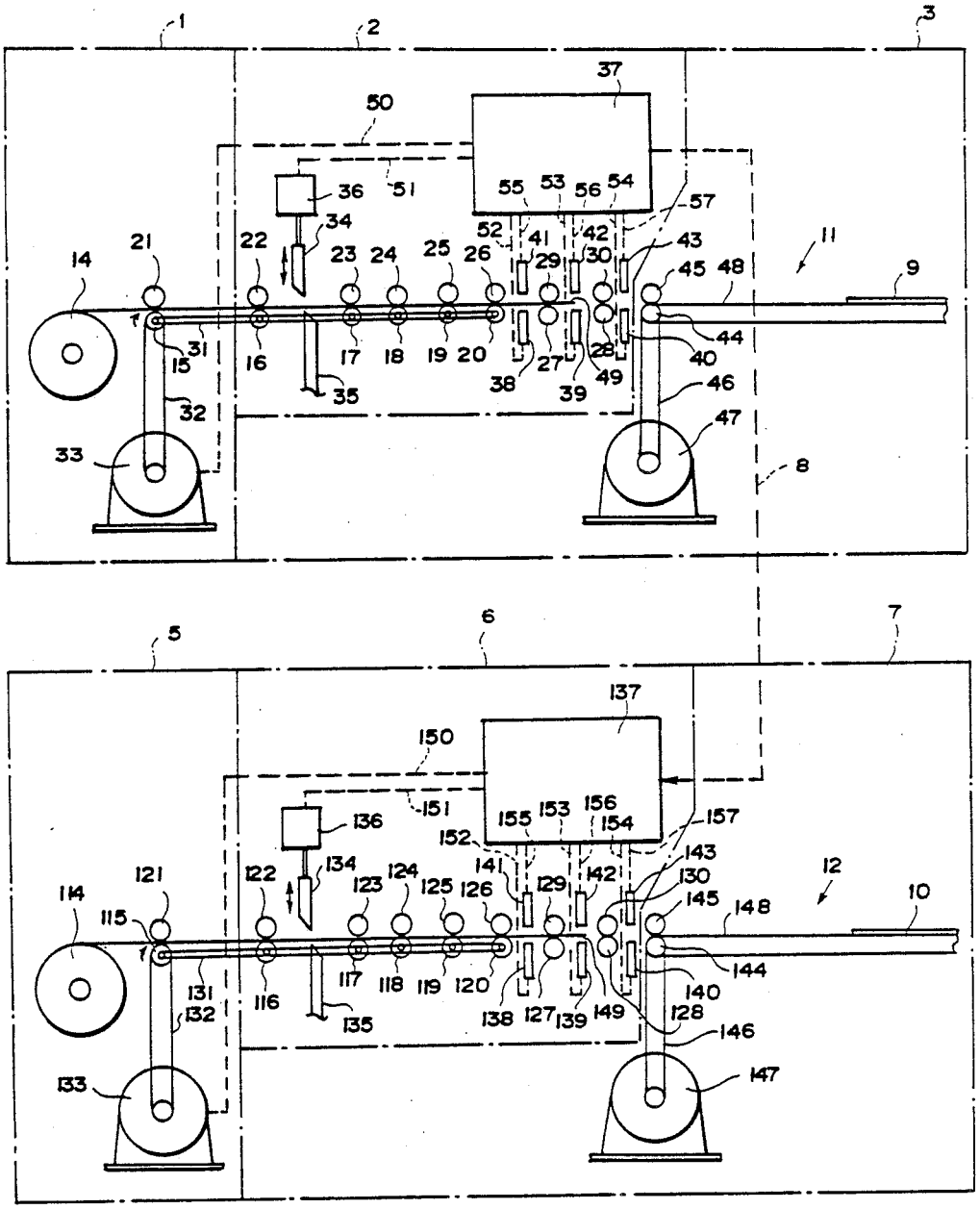
FIG. 4 is a schematic view showing an apparatus for carrying out the embodiment shown in FIG. 1.

FIG. 4 shows the sections of a sheet processing apparatus corresponding to the block diagram shown in FIG. 1 on the sides upstream from the product sheet conveyance means 3 and the division sheet conveyance means 7.

With reference to FIG. 4, a product web 14 in the rolled form is unwound and fed between drive rollers 15, 16, 17, 18, 19, 20, and hold-down rollers 21, 22, 23, 24, 25, 26. The drive rollers 15 to 20 are operated by a drive device 33, which is started or stopped by control signals 50 received from a control device 37, via chains 31 and 32. The hold-down rollers 21 to 26 hold the product web 14 from above so that the product web 14 does not slip on the drive rollers 15 to 20 when the product web 14 is fed. Guide rollers 27 and 28 guide the product web 14 or the product sheet 9 so that it passes between the guide roller 27 and a hold-down roller 29 and between the guide roller 28 and a hold-down roller 30. An upper cutter blade 34 is coupled with a cylinder device 36 and is moved up and down by the cylinder device 36 operated in response to control signals 51. As the upper cutter blade 34 is moved down, the product web 14 is cut by the upper cutter blade 34 and a lower cutter blade 35. Light emitting operations of light emitting devices 38, 39 and 40 are controlled respectively by light emission control signals 52, 53 and 54, and light reception signals 55, 56 and 57 which indicate whether the light emitted by the light emitting devices 38, 39 and 40 is or is not received by light receiving devices 41, 42 and 43 are sent to the control device 37. Power of a drive device 47 is transmitted to a drive roller 44 via a chain 46, and the drive roller 44 is rotated to operate the product sheet conveyor 11. A hold-down roller 45 holds the product sheet 9 so that the product sheet 9 does not slip on a belt 48 of the product sheet conveyor 11 when the product sheet 9 is fed onto the belt 48.

In this embodiment, the division sheet web feed-out means 5, the division sheet web cutting means 6, and the division sheet conveyance means 7 are constituted in the same manner as mentioned above.

Specifically, a division sheet web 114 in the rolled form is unwound and, fed between drive rollers 115, 116, 117, 118, 119, 120, and hold-down rollers 121, 122, 123, 124, 125, 126. The drive rollers 115 to 120 are operated by a drive device 133, which is started or stopped by control signals 150 received from a control device 137, via chains 131 and 132. The hold-down rollers 121 to 126 hold the division sheet web 114 from above so that the division sheet web 114 does not slip on the drive rollers 115 to 120 when the division sheet web 114 is fed. Guide rollers 127 and 128 guide the division sheet web 114 or the division sheet 10 so that it passes between the guide roller 127 and a hold-down roller 129 and between the guide roller 128 and a hold-down roller 130. An upper cutter blade 134 is coupled with a cylinder device 136 and is moved up and down by the cylinder device 136 operated in response to control signals 151. As the upper cutter blade 134 is moved down, the division sheet web 114 is cut by the upper cutter blade 134 and a lower cutter blade 135. Light emitting operations of light emitting devices 138, 139 and 140 are controlled respectively by light emission control signals 152, 153 and 154, and light reception signals 155, 156 and 157 which indicate whether the light emitted by the light emitting devices 138, 139 and 140 is or is not received by light receiving devices 141, 142 and 143 are sent to the control device 137. Power of a drive device 147 is transmitted to a drive roller 144 via a chain 146, and the drive roller 144 is rotated to operate the division sheet conveyor 12. A hold-down roller 145 holds the division sheet 10 so that the division sheet 10 does not slip on a belt 148 of the division sheet conveyor 12 when the division sheet 10 is fed onto the belt 148.

Operations of the apparatus shown in FIG. 4 will be described hereinbelow.

The product web 14 is unwound from the web roll by the drive rollers 15 to 20 and is moved forward. On the other hand, one of the light emitting devices 38, 39, 40 and one of the light receiving devices 41, 42 and 43 that corresponds to said one of the light emitting devices 38, 39, 40 are selected by the control device 37 in accordance with the size of the product sheet 9. In FIG. 4, the light emitting device 39 and the light receiving device 42 are selected. At the time a leading edge 49 of the product web 14 has advanced to the position between the light emitting device 39 and the light receiving device 42 which are selected as mentioned above, the light emitted by the light emitting device 39 is intercepted by the product web 14, and therefore the light reception signal 56 which indicates that no light is received is sent by the light receiving device 42 to the control device 37. Then, the control device 37 sends the control signal 50 for instructing the stop of operation to the drive device 33, so that the operation of the drive device 33 is stopped and the movement of the product web 14 is stopped. The control device 37 then sends the control signal 51 for instructing the downward movement of the upper cutter blade 34 to the cylinder device 36. In this manner, the upper cutter blade 34 is moved down, and the product web 14 is cut in a predetermined size to form the product sheet 9. Thereafter, the control signal 51 for instructing the upward movement of the upper cutter blade 34 is sent from the control device 37 to the cylinder device 36, and the upper cutter blade 34 is moved up. At this time, the control device 37 counts the number of the product sheets 9, 9,. . . formed in this manner, and stores the number. The control signal 50 for instructing the restart of operation is then sent from the control device 37 to the drive device 33. As a result, the drive rollers 15 to 20 are rotated again, and the product sheet 9 and the product web 14 are moved rightward in FIG. 4. The product sheet 9 is conveyed by the belt 48 of the product sheet conveyor 11. The product web 14 is moved forward until its leading edge 49 arrives at the position between the light emitting device 39 and the light receiving device 42, and is stopped. Thereafter, the same operations as mentioned above are repeated.

The division sheet web 114 is unwound from the web roll by the drive rollers 115 to 120 and is moved forward. On the other hand, one of the light emitting devices 138, 139, 140 and one of the light receiving devices 141, 142 and 143 that corresponds to said one of the light emitting devices 138, 139, 140 are selected by the control device 137 in accordance with the size of the division sheet 10. The selection is carried out in accordance with the information on the size of the product sheet 9, which is generated by the control device 37 and sent by the product sheet information transmitting means 8 to the control device 137. In FIG. 4, the light emitting device 139 and the light receiving device 142 are selected. At the time a leading edge 149 of the division sheet web 114 has advanced to the position between the light emitting device 139 and the light receiving device 142 which are selected as mentioned above, the light emitted by the light emitting device 139 is intercepted by the division sheet web 114, and therefore the light reception signal 156 which indicates that no light is received is sent by the light receiving device 142 to the control device 137. Then, the control device 137 sends the control signal 150 for instructing the stop of operation to the drive device 133, so that the operation of the drive device 133 is stopped and the movement of the division sheet web 114 is stopped. In this condition, the predetermined number of the product sheets 9, 9, . . . are formed in the manner as mentioned above, the information on the timing of the formation of the division sheet 10 which is to be fed next is transmitted by the product sheet information transmitting means 8 from the control device 37 to the control device 137, and the division sheet web 114 is made to wait for the timing of the formation of the division sheet 10. At the time the division sheet 10 is to be formed, the control device 137 sends the control signal 151 for instructing the downward movement of the upper cutter blade 134 to the cylinder device 136. In this manner, the upper cutter blade 134 is moved down, and the division sheet web 114 is cut in a predetermined size to form the division sheet 10. Thereafter, the control signal 151 for instructing the upward movement of the upper cutter blade 134 is sent from the control device 137 to the cylinder device 136, and the upper cutter blade 134 is moved up. In this embodiment, the apparatus may be constituted so that the product web 14 is made to wait and the formation of the product sheet 9 is interrupted in the same manner as the waiting of the division sheet web 114 when necessary in the step of the formation of the division sheet 10. The control signal 150 for instructing the restart of operation is then sent from the control device 137 to the drive device 133. As a result, the drive rollers 115 to 120 are rotated again, and the division sheet 10 and the division sheet web 114 are moved rightward in FIG. 4. The division sheet 10 is conveyed by the belt 148 of the division sheet conveyor 12. The division sheet web 114 is moved forward until its leading edge 149 arrives at the position between the light emitting device 139 and the light receiving device 142, and is made to wait in this condition. Thereafter, the same operations as mentioned above are repeated. The product sheet information transmitting means 8 is not limited to a particular means, and may be a known electric signal communication means such as RS 232C or GP-IP, a wire communication means, a radio communication means, or an information transmitting means based on mechanical coupling.

Figure 5:
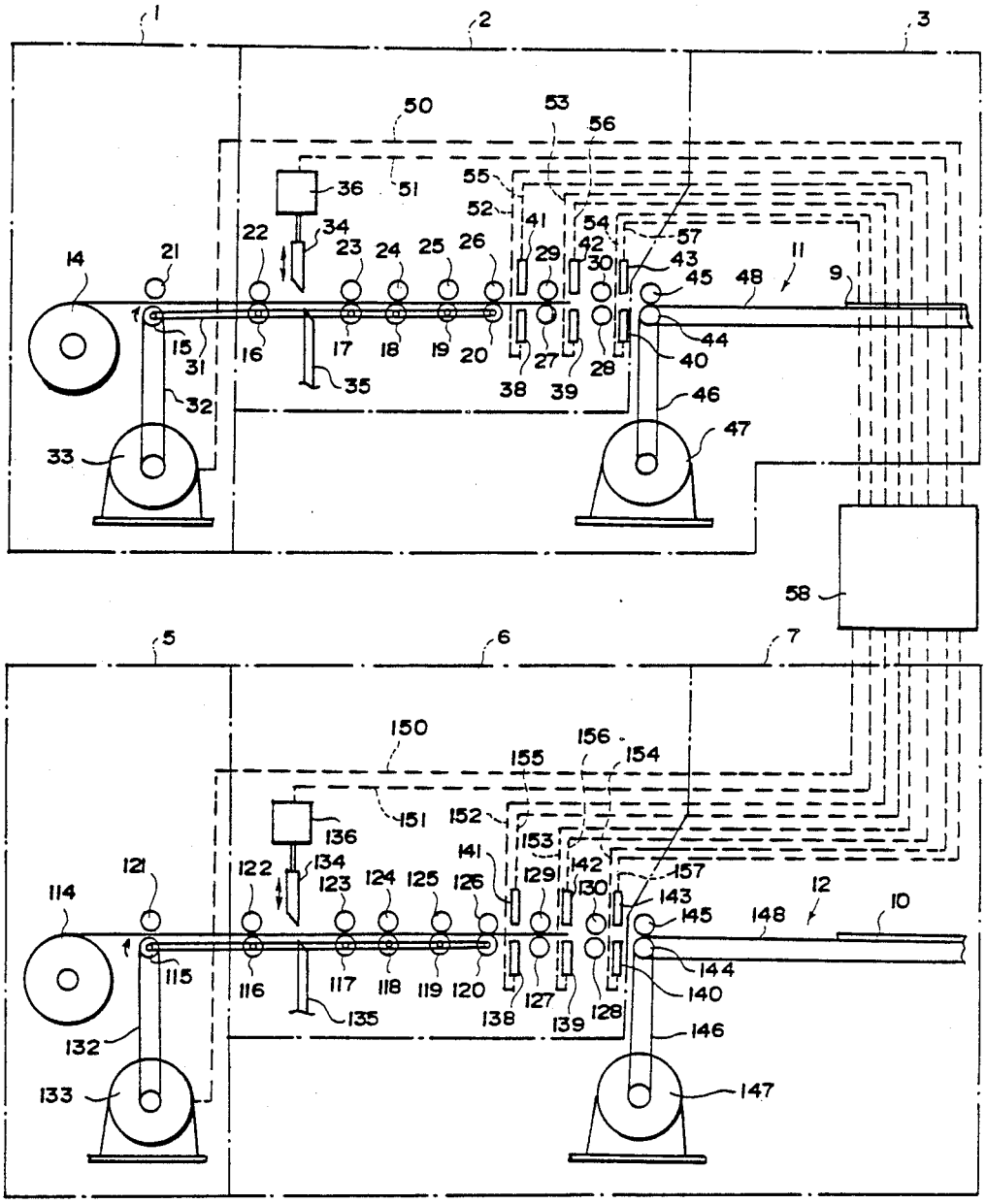
FIG. 5 is a schematic view showing an apparatus for carrying out another embodiment of the division sheet feeding method in accordance with the present invention.

An apparatus for carrying out another embodiment of the division sheet feeding method in accordance with the present invention will be described hereinbelow with reference to FIG. 5. In FIG. 5, similar elements are numbered with the same reference numerals with respect to FIG. 4. In this embodiment, the control functions of the control devices 37 and 137 connected by the product sheet information transmitting means 8 in the embodiment shown in FIG. 4 are achieved by a single control device 58. In the case where the apparatus for processing the product web into the product sheets and stacking the product sheets is already present and the apparatus for cutting the division sheet web and feeding the division sheets thus formed to the division sheet conveyance means is to be added to the apparatus for processing the product web, the two control devices may be provided as shown in FIG. 4. However, in the case where the whole apparatus is designed from the original step, it is often advantageous to combine the control devices into a single device as shown in FIG. 5.

Figure 6:
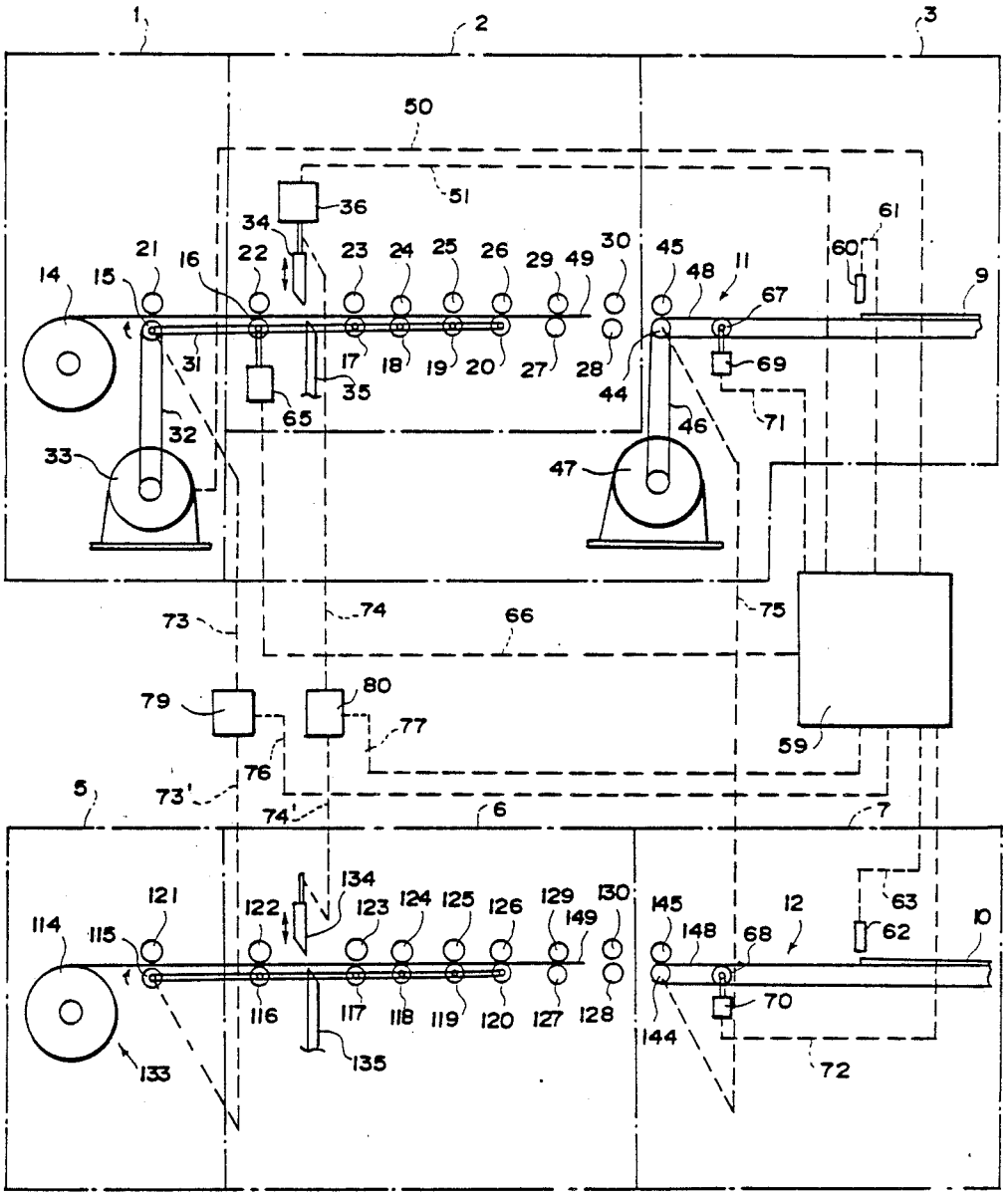
FIG. 6 is a schematic view showing an apparatus for carrying out a further embodiment of the division sheet feeding method in accordance with the present invention.

An apparatus for carrying out a further embodiment of the division sheet feeding method in accordance with the present invention will hereinbelow be described with reference to FIG. 6. In this embodiment, the number of rotations of the roller 16 is counted by a rotary encoder 65, the count signals are sent as rotation signals 66 to a control device 59, and the control device 59 calculates the dimension from the leading edge 49 of the product web 14 to the position between the upper cutter blade 34 and the lower cutter blade 35 on the basis of the rotation signals 66. Photoelectric devices 60 and 62 respectively detect whether the product sheet 9 is or is not present exactly below the photoelectric device 60 and whether the division sheet 10 is or is not present exactly below the photoelectric device 62. The results of the detection are sent as detection signals 61 and 63 to the control device 59. Also, the number of rotations of a roller 67 and the number of rotations of a roller 68 are counted by rotary encoders 69 and 70 respectively connected to the rollers 67 and 68, and the count signals are sent as rotation signals 71 and 72 to the control device 59. Based on the received signals, the control device 59 detects whether the product sheet 9 and the division sheet 10 are cut to predetermined sizes. Also, the number of the product sheets 9, 9, . . . passing below the photoelectric device 60 is counted and stored. The drive roller 115 is coupled with the drive roller 15 by mechanical coupling members 73 and 73' via a clutch device 79 which is controlled by control signals 76. The upper cutter blade 134 is coupled with the upper cutter blade 34 by mechanical coupling members 74 and 74' via a clutch device 80 which is controlled by control signals 77. The drive roller 144 is coupled with the drive roller 44 by a mechanical coupling member 75.

The product web 14 is unwound from the web roll by the drive rollers 15 to 20 and is moved forward. At the time it is detected that the drive roller 16 has been rotated a predetermined number of times in accordance with the size of the product sheet 9 on the basis of the rotation signals 66 generated by the rotary encoder 65, the drive device 33 is stopped based on the control signals 50, and the product web 14 is cut to form the product sheet 9 on the basis of the control signals 51. Then, the drive device 33 is restarted on the basis of the control signals 50, and the product sheet 9 is conveyed on the belt 48 of the product sheet conveyor 11. In the course of the conveyance of the product sheet 9, the control device 59 calculates the size of the product sheet 9 on the basis of the detection signals 61 received from the photoelectric device 60 and the rotation signals 71 received from the rotary encoder 69, judges whether the product sheet 9 is formed in the predetermined size or not, and counts the number of the product sheets 9, 9, . . . which have been conveyed.

On the other hand, the driving force of the drive device 33 is transmitted to the drive roller 115 via the mechanical coupling 73 and 73' and the clutch device 79, thereby to unwind the division sheet web 114 and to move it forward. At the time the leading edge of the product web 14 has advanced to the predetermined position and the drive device 33 is stopped, the leading edge of the division sheet web is also stopped simultaneously. At this stage, the clutch members (not shown) of the clutch device 79 is disengaged from each other by the control signals 76 generated by the control device 59, and the mechanical coupling members 73 and 73' are disconnected from each other. The clutch members (not shown) of the clutch device 80 are also disengaged from each other by the control signals 77 generated by the control device 59, and the mechanical coupling members 74 and 74' are disconnected from each other. At the time the control device 59 detects that the predetermined number of the product sheets 9, 9, . . . have been conveyed, the clutch members (not shown) of the clutch device 80 are engaged with each other by the control signals 77. At the same time as the formation of the product sheet 9 by the cutting of the product web 14 on the basis of the control signals 51, the division sheet web 114 is cut to form the division sheet 10. Thereafter, the clutch members (not shown) of the clutch device 79 are engaged with each other on the basis of the control signals 76. As the drive device 33 is restarted on the basis of the control signals 50, the division sheet 10 is conveyed on the belt 48 of the division sheet conveyor 12. In the course of the conveyance of the division sheet 10, the control device 59 calculates the size of the division sheet 10 on the basis of the detection signals 63 received from the photoelectric device 62 and the rotation signals 72 received from the rotary encoder 70, and judges whether the division sheet 10 is formed in the predetermined size or not. By the repetition of the aforesaid operations, the division sheet 10 is formed for each group of the predetermined number of the product sheets 9, 9, . . .

As will be clear from the aforesaid embodiments, the division sheet feeding method in accordance with the present invention is constituted so that the division sheet web is cut and processed to form the necessary number of the division sheets each time the predetermined number of the product sheets are formed. In the aforesaid embodiments, as processing, only the cutting of the web into predetermined lengths is carried out. However, the present invention is applicable also to the cases where the process of cutting the web to have a predetermined width and other processes such as printing on the division sheet are included in the middle of the procedure. The form of the web is not limited to the rolled form, and the present invention is applicable also to the web in the sheet form. Also, the conveyance means is not limited to the conveyor. For example, the division sheets formed may be stacked at the predetermined position by the falling by their weight or by suction. The number of the division sheets necessary for a single insertion step is not limited to one, and a plurality of the division sheets may be fed by a single insertion step. Feeding of a plurality of the division sheets by a single insertion step may be effected by, for example, carrying out the control in the appropriate manner in the embodiment shown in FIG. 4, and by any other manners.

I claim:

1. A division sheet feeding apparatus for laying at least one division sheet upon a stack of a predetermined number of product sheets each time the predetermined number of product sheets are stacked one upon another, comprising:

a product web;

means for cutting said product web into product sheets;

means for feeding said product web to said cutting means for cutting said product web into product sheets of a predetermined product sheet size;

means for determining whether product sheets cut from said product web by said cutting means are cut to said predetermined product sheet size;

means for stacking said product sheets;

means for counting a number of product sheets stacked by said stacking means;

a division web;

means for cutting said division web into division sheets of a predetermined division sheet size which is at least the same size as said predetermined product sheet size;

means for determining whether said division sheets are cut to said predetermined division sheet size; and means for feeding at least one of said division sheets onto said stack when said counting means reaches a predetermined count.

2. The division sheet feeding apparatus of claim 1, wherein said means for determining whether said product and division sheets are cut to said predetermined product and division sheet sizes each comprises a roller, a rotary encoder for producing a signal indicative of a number of rotations of said roller, and means for counting pulses contained in said signal indicative of said number of rotations.

3. The division sheet cutting apparatus of claim 2, wherein said means for determining whether said product and division sheets are cut to said predetermined product and division sheet sizes each further comprises photoelectric detecting means.

4. The division sheet cutting apparatus of claim 1, wherein said means for cutting said product sheets from said product web and said means for cutting said division sheets from said division web each comprise a fixed cutter blade and a movable cutter blade, and wherein said means for cutting said division sheets from said division web further comprises clutch means for selectively coupling said movable blade of said means for cutting said division sheets from said division roll to said movable blade of said means for cutting said product sheets from said product web, and means for actuating said clutch means in response to said counting means.

* * * * *